US009340853B2

(12) United States Patent
Lhuillier

(10) Patent No.: US 9,340,853 B2
(45) Date of Patent: May 17, 2016

(54) CU—AL—NI—FE ALLOY AND SENSOR FOR MEASURING A PHYSICAL PARAMETER COMPRISING A COMPONENT MADE OF SUCH AN ALLOY

(75) Inventor: Bruno Lhuillier, Les Bordes (FR)

(73) Assignee: AUXITROL SA, Bourges (FR)

( * ) Notice: Subject to any disclaimer, the term of this patent is extended or adjusted under 35 U.S.C. 154(b) by 1081 days.

(21) Appl. No.: 12/005,824

(22) Filed: Dec. 28, 2007

(65) Prior Publication Data

US 2008/0193325 A1 Aug. 14, 2008

Related U.S. Application Data

(63) Continuation-in-part of application No. 10/732,590, filed on Dec. 10, 2003, now abandoned.

(30) Foreign Application Priority Data

Dec. 23, 2002 (FR) ..... 02 16506

(51) Int. Cl.
*C22C 9/06* (2006.01)
*C22C 9/01* (2006.01)

(52) U.S. Cl.
CPC .... *C22C 9/01* (2013.01); *C22C 9/06* (2013.01)

(58) Field of Classification Search
USPC ..... 148/435; 420/486; 374/30, 100
IPC ..... C22C 9/01,9/06; G01B 1/00
See application file for complete search history.

(56) References Cited

U.S. PATENT DOCUMENTS 2,031,315 A * 2/1936 Jennison ..... 420/486
2,789,900 A * 4/1957 Hannon ..... 420/486
4,589,938 A 5/1986 Drosdick
5,021,105 A 6/1991 Asai et al.

(Continued)

FOREIGN PATENT DOCUMENTS

DE 1558471 3/1970
DE 19930741 1/2001

(Continued)

OTHER PUBLICATIONS

Database WPI; Section EI, Week 198136; Derwent Publications Ltd., London, GB; Class U11, AN 1981-J3562D; XP002260904; Voron Poly; Nov. 15, 1990 & SU780083.

(Continued)

*Primary Examiner* — Sikyin Ip
(74) *Attorney, Agent, or Firm* — Blakely Sokoloff Taylor & Zafman LLP

(57) ABSTRACT

The invention relates to an alloy permitting to replace the current CuBe alloy, soon to be prohibited by the various environmental directives because of the presence of Be and for which there is currently no substitution alloy with similar desired thermal and mechanical properties for measuring physical parameters, notably in aeronautics. This alloy is a Cu—Al—Ni—Fe alloy and the balance is copper. It contains from 3.8 to 4.4 wt % aluminum, from 4.2 to 5 wt % nickel, from 1.7 to 5 wt % iron, additives including silicon, manganese, chromium and titanium, silicon being present at less than 0.8 wt %, manganese being present at less than 0.15 wt %, chromium being present at less than 0.3 wt %, titanium being present at less than 0.1 wt %, the other chemical elements having contents by weight of less than 1%, each being present at less than 0.05 wt % and the balance is copper.

3 Claims, 1 Drawing Sheet

(56) References Cited

U.S. PATENT DOCUMENTS

| | | | |
|---|---|---|---|
| 5,104,457 | A | 4/1992 | Viljoen et al. |
| 2004/0115089 | A1 | 6/2004 | Rechtziegel et al. |

FOREIGN PATENT DOCUMENTS

| | | | |
|---|---|---|---|
| EP | 1066911 | | 1/2001 |
| FR | 2849060 | | 6/2004 |
| GB | 744523 | | 2/1956 |
| GB | 873404 | | 7/1961 |
| GB | 1513407 | | 6/1978 |
| GB | 1554843 | | 10/1979 |
| JP | 10122977 | * | 5/1998 |
| JP | 2002038246 | | 2/2000 |
| JP | 2002318248 | | 2/2003 |

OTHER PUBLICATIONS

Dos Santos, C.M.L., et al., "Microstructural and microtextual analyses of a Cu—Al—Ni shape memory alloy single crystal," 58th Congresso Anual—Assosiacao Brasileira de Metalurgia e Materiais, (2003), pp. 3045-3053.

* cited by examiner

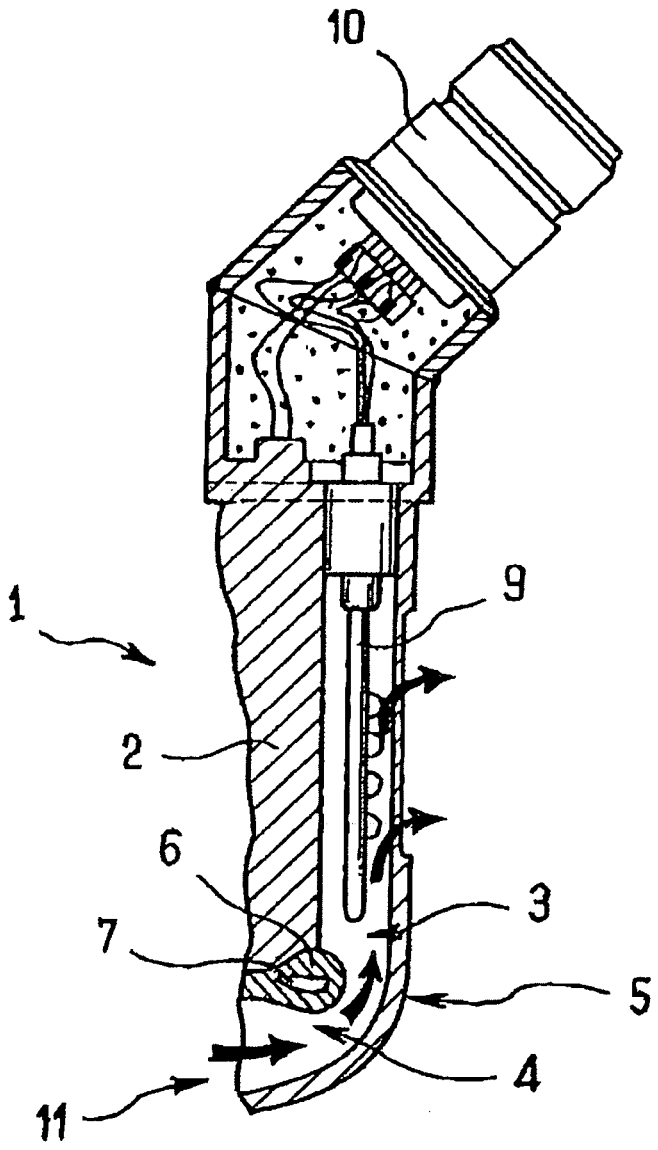
10
1
9
2
6
3
7
5
4
11

CU—AL—NI—FE ALLOY AND SENSOR FOR MEASURING A PHYSICAL PARAMETER COMPRISING A COMPONENT MADE OF SUCH AN ALLOY

CROSS-REFERENCE TO RELATED APPLICATIONS

This application is a continuation-in-part of prior application Ser. No. 10/732,590, filed Dec. 10, 2003, now abandoned, which claims the benefit of priority from France Patent Application No. 0216506, filed on Dec. 23, 2002, the entire contents of which are incorporated herein by reference.

The present invention relates to copper alloys.

More particularly, it relates to alloys having mechanical, thermal and electrical properties allowing them to be used in sensors that are highly stressed both thermally and mechanically, and in particular in sensors used in the field of aeronautics, for example for total air temperature measurement and/or static or total pressure measurement at an engine inlet or else for measurements on the outside of aircraft.

Many sensors in this sense are already known.

In particular, deiced total air temperature sensors of the type shown in FIG. 1 are already known.

Such a sensor 1 has in particular an air intake 11 attached to a profiled body 2 in which a duct 3 is made, allowing flow of the fluid which is to be measured and communicating with the air intake via an inertial separation region 4. This region separates, from the air, the components of relatively large mass compared with the latter (namely water, ice, sand, etc.) by centrifugation, these components being removed from the sensor through an ejection region 5 on the opposite side from the air intake. To avoid the fluid detachment phenomena in the inertial separation region 4, holes 6 are provided in the wall of the latter, on the opposite side from the ejection region 5, and communicate with the outside via a chamber 7 that extends transversely through the thickness of the profiled body 2. The pressure differential existing between the inside and the outside of the sensor allows suction of the boundary layer via the holes 6.

The air intake 11/profiled body 2/duct 3/inertial separation region 4/ejection region 5 assembly is electrically de-iced by resistance heating elements.

A component forming a measurement sensor extends along the inside of said duct 3. This component 9 is, for example, a platinum wire constituting a thermometer resistance thermally isolated from the profiled body 2.

The various wires forming a thermometer resistance or heating resistance element are connected to a connection socket 10.

The profiled body of this sensor is generally made of a beryllium-copper alloy.

This is because beryllium-copper alloys exhibit excellent mechanical, thermal and electrical properties in their various metallurgical states: a yield strength of 150 to 1000 MPa and higher, a tensile strength of 300 to 1000 MPa and higher, an elongation at break of up to 60% and a thermal conductivity of 100 W/m·K and higher.

Although the presence of beryllium improves the general properties of the material, beryllium metal dust is, however, toxic and presents a hazard to an operator during machining or assembling operations.

Out of concern for protecting operators, it is nowadays desired to be able to use alloys containing no beryllium.

Many Cu—Al—Ni—Fe alloys are already known.

The invention itself proposes a Cu—Al—Ni—Fe alloy containing from 3 to 6 wt % aluminum, from 3 to 6.5 wt % nickel, from 1 to 4.5 wt % iron, from 0.1 to 1 wt % silicon, from 0.1 to 1 wt % manganese and from 0.05 to 1 wt % tin, the other chemical elements having contents by weight of less than 1%, and the balance is copper.

More particularly, it proposes a Cu—Al—Ni—Fe alloy containing from 3 to 4.5 wt % aluminum, from 4 to 6.5 wt % nickel, from 1 to 2.1 wt % iron, from 0.1 to 1 wt % silicon, less than 1 wt % manganese, the other chemical elements having a total content by weight of less than 1%, and the balance is copper.

According to another aspect, Applicant has selected a Cu—Al—Ni—Fe alloy which surprisingly provides better thermal and mechanical characteristics while permitting there repeatability from one cast to another.

More particularly, said alloy comprises from 3.8 to 4.4 wt % Aluminum, from 4.2 to 5 wt % Nickel, from 1.7 to 2.1 wt % Iron, Silicon being present with less than 0.8 wt %, Manganese being present with less than 0.15 wt %, Chromium with less than 0.3 wt %, Titanium with less than 0.1 wt %, the totality of the other chemical elements representing less than 1 wt %, each element being present with a content in weight of less than 0.05 wt %, balance being made up by copper Other features and advantages of the invention will also become clear from the following description, which is purely illustrative and nonrestricting, and must be read in conjunction with the single appended FIGURE giving a total air temperature sensor.

A sensor according to one possible embodiment comprises a structure of the type illustrated in FIG. 1, in which the part constituting the profiled body 2 and the air intake 11 is made of a Cu—Al—Ni—Fe alloy having as composition:

from 3 to 6 wt % aluminum, preferably from 3 to 4.5 wt %;

from 3 to 6.5 wt % nickel, preferably from 4 to 6.5 wt % from 1 to 4.5 wt % iron, preferably from 1 to 2.1 wt % from 0.1 to 1 wt % silicon; from 0.1 to 1 wt % manganese or less than 1 wt % manganese from 0.05 to 1 wt % tin.

The elements other than Cu, Al, Ni, Fe, Si, Mg and Sn have contents by weight of less than 1%.

The balance is made up by copper.

On as-cast batches, the mechanical properties are around 200 MPa and higher in the case of the yield strength, 300 MPa and higher in the case of the tensile strength, 10% and higher in the case of the elongation at break and 50 W/m·K and higher in the case of the thermal conductivity.

Such an alloy exhibits excellent castability properties.

However, it should be noted that it can be produced in ways other than by casting, especially by sintering.

In the case of a foundry treatment, this may be a crude foundry treatment, a foundry treatment with a heat treatment, and these may or may not be followed by forming treatments (for example machining), a foundry treatment followed immediately by forming operations (for example machining).

The parts obtained with such an alloy (whether or not obtained by casting) can be joined together perfectly using various welding techniques, various brazing techniques and various braze-welding techniques.

The alloy also exhibits excellent machinability.

It should be noted that, in a particularly advantageous composition, the elements other than Cu, Al, Ni, Fe, Si, Mg and Sn have contents by weight of less than 0.1%.

As a more particular example, an alloy used to produce the sensor body is advantageously an alloy whose composition comprises around 4.5 wt % aluminum, around 4 wt % nickel, around 2 wt % iron, around 0.5 wt % silicon, around 0.3 wt % manganese and around 0.1 wt % tin.

Such an alloy has a yield strength of 230 MPa, a tensile strength of 400 MPa, an elongation at break of 18% and a thermal conductivity of 70 W/m·K.

According to another selection provided by the invention, the sensor as illustrated in FIG. 1 presents a profiled body 2 and an air intake 11 made of Cu—Al—Ni—Fe alloy has composition from 3.8 to 4.4 wt % aluminum;
from 4.2 to 5 wt % nickel;
from 1.7 to 2.1 wt % iron;

The composition also comprises additives including Silicon, Manganese, Chromium, Titanium, with the following mass percentage less than 0.8 wt % silicon;
less than 0.15 wt % manganese
less than 0.3 wt % chromium;
less than 0.1 wt % titanium.

These values are maximum values measured on the final product. Part of these additives are vaporized during melting of the alloy. These additives are nevertheless necessary to warrant the qualities of the alloy. For example, Titanium added as anti-oxidizing is consummated during melting of the alloy to trap the oxygen and is only present with 0.1 wt % as a residual maximum on the final product.

It should be noted that limitation of the tolerances on the main compounds permits to warrant repeatability of the thermal and mechanical characteristics and therefore limits gaps of performance from one manufacturing lot to another.

Additives added during melting, such as Titanium, Chromium, Silicon, Manganese, permit to warrant the following properties:

castability and fluidity of the melted alloy due to the presence of silicon;
non oxidation of the melted alloy under action of titanium which, through its own consumption, consummates oxygen;
high mechanical properties due to the action of manganese and chromium on the spot joint.

Combined action of all these additives permits to warrant a very good quality of the material, in particular with absence of cracking, compressions, or lack of material within small details.

The elements other than Cu, Al, Ni, Fe, Si, Mn, Cr, and Ti all have less than 0.05 wt %, for a total weight less than 1 wt %.

Copper is the balance.

Such an alloy exhibits excellent castability in smelting works and permits to obtain the small geometrical details necessary to the optimization of the performance of the sensors.

It warrants a given level of reproducibility in the geometry of the piece works realized through smelting treatment and therefore stability of performance from one sensor to another.

It provides a good ability to manufacturing through conventional means or electro-erosion.

It is adapted for any joining technique such as brazing, welding, braze-welding, gluing, on a piece works of the same alloy or of stainless steel.

It warrants mechanical internal properties similar to dose of CuBe, without any particular thermal treatment.

It is adapted for electrolytic or chemical surface treatments.

Additionally, it provides a good resistance to saline environments and corrosion.

On as-cast batches, the mechanical properties are around 200 Mpa and higher in the case of the yield strength, 350 Mpa and higher in the case of the tensile strength, 12% and higher in the case of the elongation at break and 50 W/m·K and higher in the case of the thermal conductivity. The values provide a good repeatability from one cast to another. The additives permit to improve and warrant the good quality and castability of the material.

In the case of foundry treatment, this may be a crude foundry treatment, a foundry treatment with a heat treatment, and these may or may not be followed by forming treatments, (for example machining), a foundry treatment followed immediately by forming operations (for example machining).

It should be noted that in general the sensor includes at least one component made of an alloy of the aforementioned type.

Advantageously, this is a sensor for measuring at least one physical parameter, such as temperature, pressure, flow rate, velocity, impact.

Particularly preferably, the proposed sensor is a sensor provided with thermal deicing means for measuring at least one physical parameter on a stream of fluid.

The sensor proposed is, for example, a sensor for measuring physical parameters at the inlet of an engine or on the outside of an aircraft.

It should be noted that, in a particularly advantageous composition, the elements other than Cu, Al, Ni, Fe, Si, Mg and Sn all have contents by weight of less than 0.05% for a total weight of less than 1%.

As a more particular example, an alloy used to produce the sensor body is advantageously an alloy composed as follows:

Cu: balance
Al: 4.464%
Ni: 4.138%
Fe: 1.857%
Si: 0.440%
Mn: 0.113%
Cr: 0.088%
Ti: 0.006%

The sensor body obtained by this foundry process called "lost-wax casting" permitting to obtain a shell in a refractory material in which said foundry alloy is cast.

The supply rates of additives such as Cr and Ti when preparing the casting are respectively 0.1% and 0.01%.

| | Re (Mpa) | Rm (Mpa | A(%) |
|---|---|---|---|
| New alloy (*) | 238 | 379 | 16.4 |
| | 227 | 351 | 18 |
| | 218 | 354 | 18 |
| Alloy (*) according to the particular example given in FR 2 849 060 | 182 | 386 | 21 |
| | 186 | 364 | 23 |
| | 178 | 351 | 30 |
| | 189 | 376 | 21 |

(*) values obtained on several cast with the same process parameters and the same casting temperatures, A being elongation in %.

Such an alloy warrants an optimum material castability in order to obtain more precise foundry details and a dimensional and geometrical repeatability of the piece works, and this while warranting a better material and high mechanical and thermal characteristics, the limitation of tolerances of the percentages of the principal components and the addition of additives permits to obtain the best compromise between castability and dimensional repeatability and mechanical characteristics.

Such an alloy has a yield strength higher than 200 MPa, a tensile strength of higher than 350 MPa, an elongation at break higher than 15% and a thermal conductivity higher than 50 W/m·K.

The invention claimed is:

1. A device for measuring at least one physical parameter on a stream of fluid, said device comprising:

an outer body with a duct formed inside the outer body for passage of the fluid, an air intake attached to the duct of the outer body, a measurement sensor housed inside the duct and extending along the inside of said duct, wherein said outer body is made of a Cu—Al—Ni—Fe—Si—Mn—Cr—Ti alloy consisting of:

from 3.8 to 4.4 wt % aluminium, from 4.2 to 5 wt % nickel, from 1.7 to 2.1 wt % iron, from 0.1 to 0.8 wt % silicon, from 0.113 to 0.15 wt % manganese, from 0.088 to 0.3 wt % chromium, from 0.006 to 0.1 wt % titanium, chemical elements as impurities, each of the chemical elements having less than 0.05 wt %, for a total weight less than 1%, and copper as balance, wherein for as-cast batches, the alloy comprises a yield strength of 200 MPa or higher, a tensile strength of 350 MPa or higher, and an elongation at break of 16.4% and higher.

2. A device provided with thermal deicing means for measuring at least one physical parameter on a stream of fluid, said device comprising:

an outer body with a duct formed inside the outer body for passage of the fluid, an air intake attached to the duct of the outer body, a measurement sensor housed inside the duct and extending along the inside of said duct, wherein said outer body is made of a Cu—Al—Ni—Fe—Si—Mn—Cr—Ti alloy consisting of:

from 3.8 to 4.4 wt % aluminium, from 4.2 to 5 wt % nickel, from 1.7 to 2.1 wt % iron, from 0.1 to 0.8 wt % silicon, from 0.113 to 0.15 wt % manganese, from 0.088 to 0.3 wt % chromium, from 0.006 to 0.1 wt % titanium, chemical elements as impurities, each of the chemical elements having less than 0.05 wt %, for a total weight less than 1%, and copper as balance, wherein for as-cast batches, the alloy comprises a yield strength of 200 MPa or higher, a tensile strength of 350 MPa or higher, and an elongation at break of 16.4% and higher.

3. A device for measuring physical parameters at the inlet of an engine or on the outside of an aircraft, comprising an outer body with a duct formed inside the outer body for passage of a fluid, an air intake attached to the duct of the outer body, a measurement sensor housed inside the duct and extending along the inside of said duct, wherein said outer body is made of a Cu—Al—Ni—Fe—Si—Mn—Cr—Ti alloy consisting of:

from 3.8 to 4.4 wt % aluminium, from 4.2 to 5 wt % nickel, from 1.7 to 2.1 wt % iron, from 0.1 to 0.8 wt % silicon, from 0.113 to 0.15 wt % manganese, from 0.088 to 0.3 wt % chromium, from 0.006 to 0.1 wt % titanium, chemical elements as impurities, each of the chemical elements having less than 0.05 wt %, for a total weight less than 1%, and copper as balance, wherein for as-cast batches, the alloy comprises a yield strength of 200 MPa or higher, a tensile strength of 350 MPa or higher, and an elongation at break of 16.4-% and higher.

* * * * *